US007578107B2

(12) United States Patent
Platt

(10) Patent No.: US 7,578,107 B2
(45) Date of Patent: Aug. 25, 2009

(54) SUSPENDED CEILING SEGMENT

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 494 days.

(21) Appl. No.: 11/293,073

(22) Filed: Dec. 2, 2005

(65) Prior Publication Data

US 2007/0130869 A1 Jun. 14, 2007

(51) Int. Cl.
*E04B 9/18* (2006.01)
*E04B 9/34* (2006.01)

(52) U.S. Cl. ..... 52/506.06; 52/506.09; 52/665

(58) Field of Classification Search ..... 52/506.07, 52/713, 665, 506.05, 506.06
See application file for complete search history.

(56) References Cited

U.S. PATENT DOCUMENTS 2,710,175 A 6/1955 Jorn
3,089,570 A * 5/1963 O'Neil, Jr. ..... 52/713
3,334,465 A 8/1967 Hoffman, Jr.
3,774,024 A * 11/1973 Deaton ..... 362/319
3,791,089 A * 2/1974 Alderman ..... 52/506.06
3,798,865 A 3/1974 Curtis
3,911,638 A * 10/1975 Englund et al. ..... 52/506.08
3,998,419 A 12/1976 Semmerling
4,064,671 A 12/1977 Sauer
4,109,437 A 8/1978 Player et al.
4,114,327 A 9/1978 Williams
4,364,215 A * 12/1982 Gailey et al. ..... 52/506.08
4,426,822 A * 1/1984 Gailey ..... 52/669
4,479,341 A * 10/1984 Schuplin ..... 52/665
4,545,165 A 10/1985 Carey et al.
4,580,387 A * 4/1986 Rogers ..... 52/665
4,624,088 A * 11/1986 Arent ..... 52/506.07
4,641,987 A 2/1987 Schlegel
4,744,188 A 5/1988 Ahren
4,757,663 A * 7/1988 Kuhr ..... 52/481.1
5,195,289 A 3/1993 LaLonde et al.
5,201,787 A 4/1993 LaLonde et al.
5,428,930 A * 7/1995 Bagley et al. ..... 52/506.07
5,551,792 A 9/1996 Witmyer
5,557,902 A 9/1996 Witmyer
5,572,844 A 11/1996 Stackenwalt et al.
5,732,521 A * 3/1998 Schmitt-Raiser ..... 52/506.07
5,822,941 A * 10/1998 Kinsella ..... 52/506.05
5,937,605 A 8/1999 Wendt
5,979,055 A * 11/1999 Sauer et al. ..... 29/897.35
6,047,512 A 4/2000 Wendt et al.
6,047,517 A 4/2000 Vrame
6,070,383 A * 6/2000 Jeanseau ..... 52/506.05
6,119,784 A * 9/2000 MacDonald et al. ..... 169/43
6,138,425 A * 10/2000 Wendt ..... 52/506.07
6,230,464 B1 5/2001 Vrame (Continued)

*Primary Examiner*—Richard E Chilcot, Jr.
*Assistant Examiner*—Alp Akbasli
(74) *Attorney, Agent, or Firm*—Eugene Chovanes

(57) ABSTRACT

A horizontally extending suspended ceiling segment that appears to float in space.

Support hangers in an upper tier connect to a grid that forms a lower tier, and cantilever the outward ends of the beams in the lower tier. A perimeter trim strip surrounds the suspended ceiling segment, on the outward ends of the beams in the grid. The support hangers, and hanger wires that support the suspended ceiling segment, are hidden behind the line of sight of a viewer positioned below the segment.

8 Claims, 9 Drawing Sheets

U.S. PATENT DOCUMENTS 6,286,265 B1 9/2001 Rinderer
6,318,042 B1 11/2001 Bloom et al.
6,477,815 B2 * 11/2002 Paul et al. ..... 52/506.06
6,729,096 B1 5/2004 Ashmore et al.
6,763,641 B1 7/2004 Ahren et al.
7,269,927 B2 * 9/2007 Savard ..... 52/506.06
7,478,787 B2 * 1/2009 Bankston et al. ..... 248/343
2004/0172907 A1 * 9/2004 Krantz-Lilienthal et al. ..... 52/506.05
2006/0101764 A1 * 5/2006 Jankovec et al. ..... 52/506.07

* cited by examiner

FIG.8
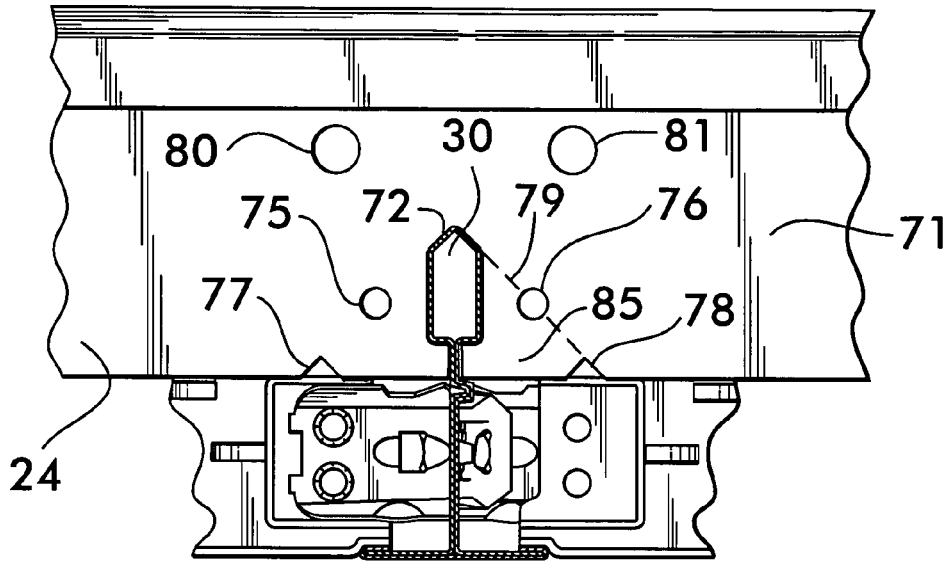
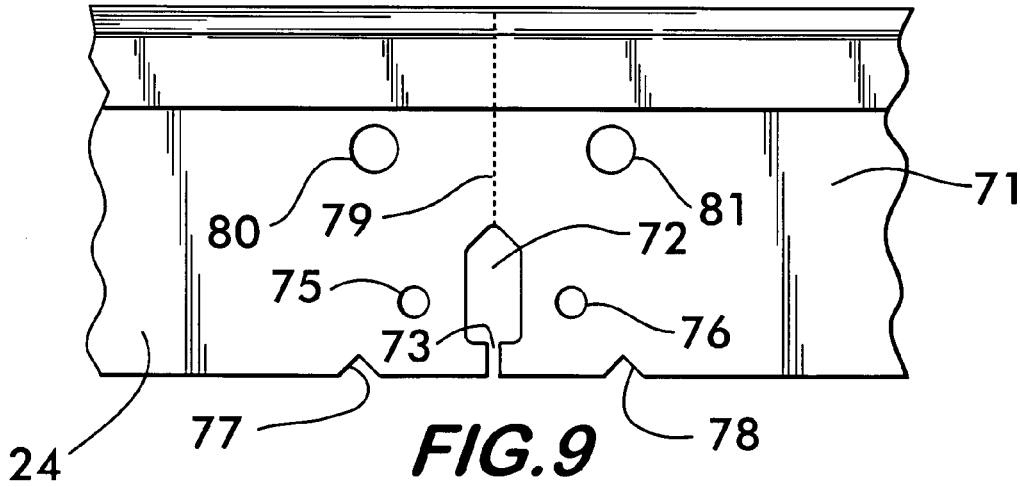
FIG.9
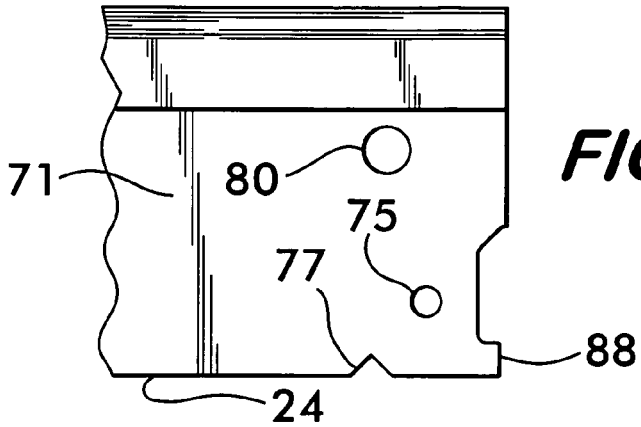
FIG.9a

FIG.12
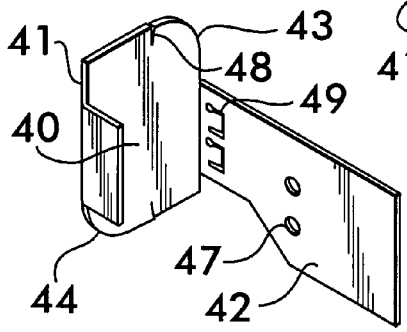
FIG.12A
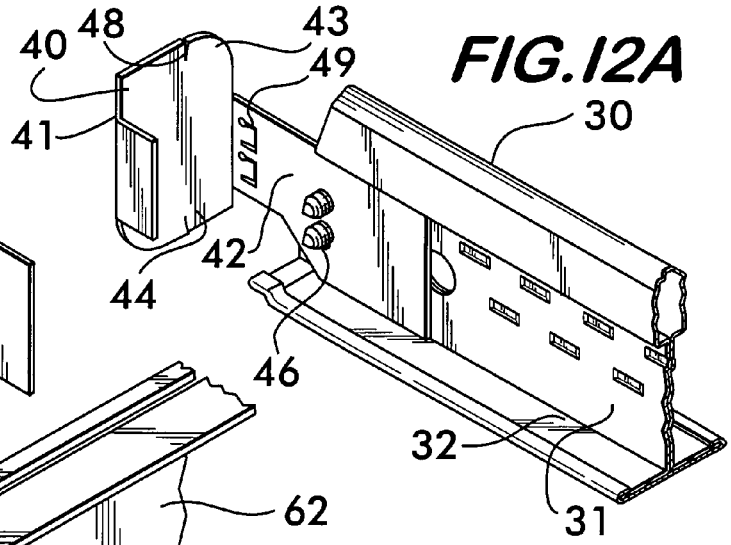
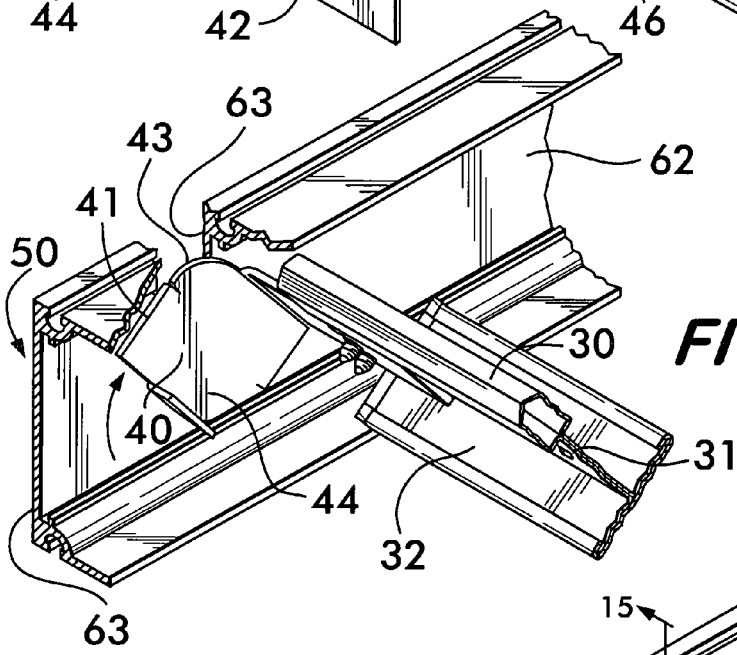
FIG.13
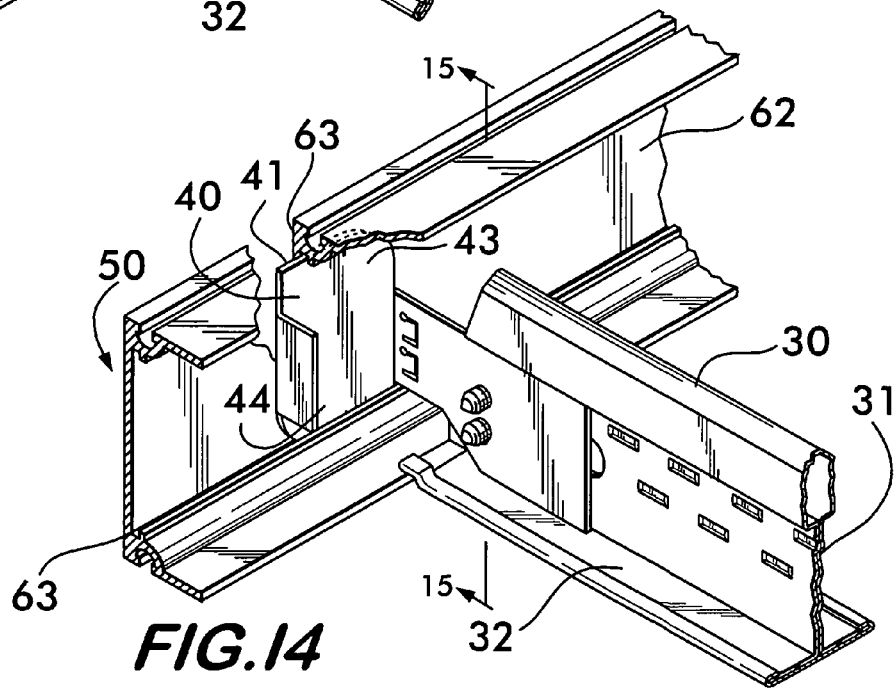
FIG.14

FIG.15
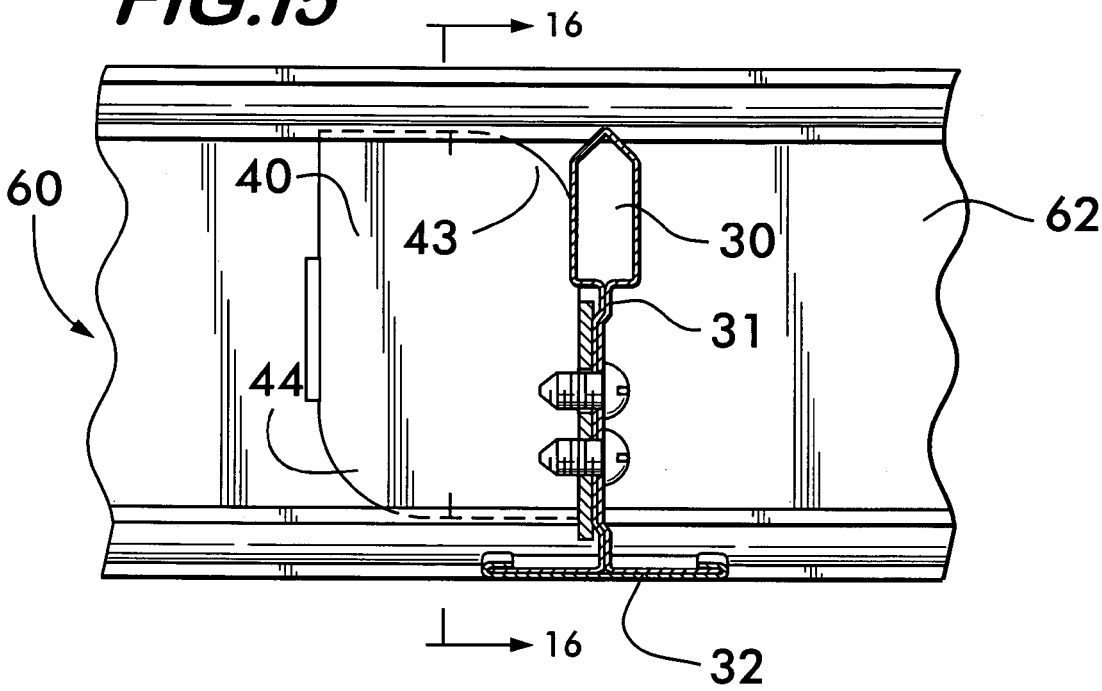
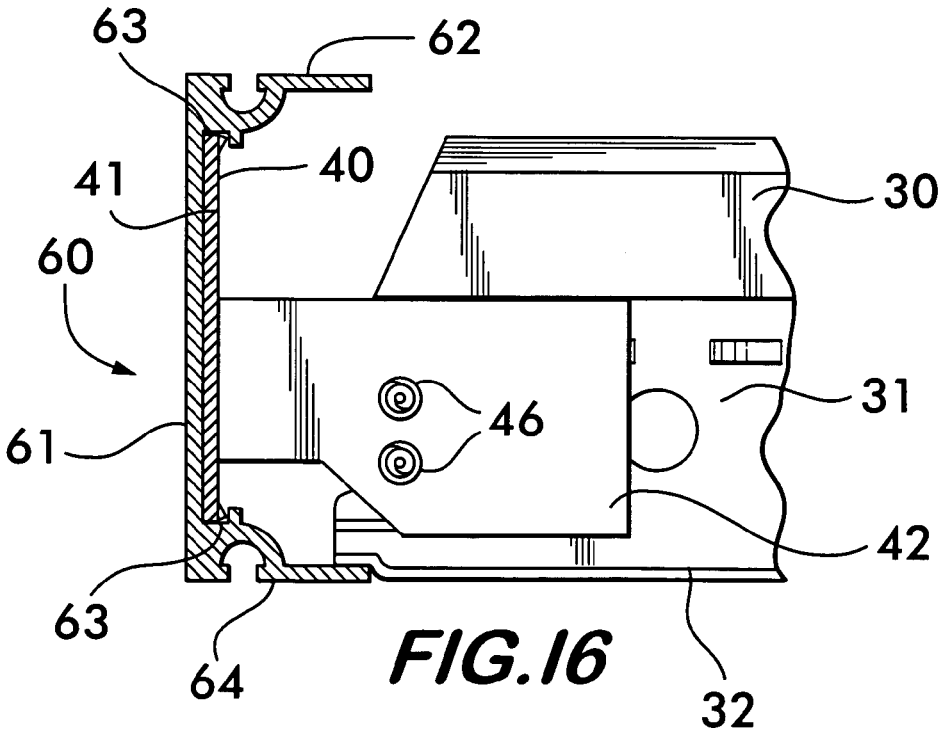
FIG.16

SUSPENDED CEILING SEGMENT

BACKGROUND OF THE INVENTION

1. Field of the Invention

The invention relates to suspended ceilings that use a grid of metal beams to support panels in grid openings. More particularly, the invention relates to a floating decorative horizontal rectangular segment of such a ceiling that hangs clear of side walls, with a perimeter trim strip that extends around the suspended ceiling segment.

2. Prior Art

In suspended ceilings, a grid of interconnected metal beams hangs from a structural ceiling by wires. The beams of the grid extend from wall to wall, and at the wall ends, the beams rest on a wall molding. The grid supports panels and lights that lie in the grid openings. The beams in such a grid are relatively light, so that it is necessary to position the hang wires at short intervals to avoid long spans of beam. It is also necessary to support the beams up to their ends, either by hang wires, or by wall moldings.

When such ceiling is viewed from any point below, nothing above the lower face of the ceiling is visible.

Sometimes, a horizontally extending decorative suspended ceiling segment, that strives to appear as floating in place, is formed away from the walls, below the wall to wall ceiling, or directly below a structural ceiling. Such a suspended ceiling segment is shown, for instance, in U.S. Pat. No. 4,744,188, incorporated herein by reference. Such a suspended ceiling segment is referred to often as a cloud, or island, to imply that it is clear of surrounding structure. Generally, the suspended ceiling segment has a square or rectangular perimeter when viewed from below. The grid of such suspended ceiling segment is suspended by hang wires from above.

The ends of the horizontally extending grid beams are connected to a perimeter trim strip, generally by bolting. Examples of such perimeter trim strip and connections are shown in U.S. Pat. Nos. 5,551,792 and 5,572,844, incorporated herein by reference. The assembly of such grid and trim strip at the perimeter is often involved and time-consuming.

Such an arrangement strives for a decorative, floating effect. Hang wires and other supporting structure, including grid elements, that appear in the line of sight to an observer below, destroy such floating effect. Hang wires near the perimeter of the suspended ceiling segment are particularly visible, and hence objectionable, but are necessary to support the grid and those beams of the grid that are near the perimeter.

BRIEF SUMMARY OF THE INVENTION

The suspended ceiling segment of the invention is made to appear floating, to an observer below, by positioning support hangers, suspended from hang wires, horizontally inward of the ceiling segment perimeter, and cantilevering the outward ends of the grid beams from the horizontally inward support hangers.

In the suspended ceiling segment of the invention, the support hangers extend horizontally in an upper tier that extends over a horizontal lower tier of grid beams. The upper tier of support hangers is joined to the lower tier of grid beams. A perimeter trim strip is connected to the grid of the segment.

The upper tier of support hangers suspended from hang wires has a horizontal spread that is smaller than the horizontal lower tier of a grid. The outwardly ends of the beams in the grid that forms the lower tier are cantilevered from the upper tier of support hangers, and do not receive direct support from hang wires or wall molding. The cantilevered portion of a beam is supported by a support hanger in the tier of support hangers only at its inward end section.

Hang wires and support hangers are hidden behind the line of sight of an observer from below, since the perimeter trim strip and the outward sections of the beams in the grid are cantilevered from the tier of support hangers, and do not require hang wires.

To connect the perimeter trim strip to the grid of the ceiling segment, the cantilevered end section of a beam is twisted manually along its longitudinal axis to permit a connector at the end of the beam to be inserted into a track in the perimeter trim strip, and then untwisted to return to its original position to permit the connector to connect quickly and simply to the perimeter trim strip.

The present invention hides the support hangers and hang wires for the ceiling segment from view. The cantilevered ends of the grid beams, with no hang wires attached, extend to the perimeter trim strip at the perimeter of the segment. The panels supported by these cantilevered sections of beam, as well as the perimeter trim strip, serve to block the view of the support hangers, as well as their hang wires, from the line of sight of an observer from below.

The end effect of the invention is to create a suspended ceiling segment, relatively easy to assemble, that hides support elements from the line of sight of an observer positioned below, so that the suspended segment appears to float.

BRIEF DESCRIPTION OF THE SEVERAL VIEWS OF THE DRAWING

FIG. 8 is a side elevational view of a section of support hanger supporting a main beam directly, and a cross beam connected to the main beam, indirectly, in the ceiling grid of the invention.

FIG. 9 is a side view of a support hanger, similar to FIG. 8, without the grid structure secured to the support hanger.

FIG. 9*a* is a portion of the support hanger shown in FIG. 9 that has been cut along the dotted line on the support hanger shown in FIG. 9.

FIG. 12 is a perspective view of a connector that secures the end of a cantilevered beam to the perimeter trim strip.

FIG. 12*a* is a perspective view of the connector of FIG. 12 secured to the end of a cantilevered beam.

FIG. 13 is a perspective view of the connector on the end of a cantilevered beam being inserted into a track on the perimeter trim strip.

FIG. 14 is a perspective view similar to FIG. 13 showing the connector fully inserted into a track of the perimeter trim strip.

FIG. 15 is a side elevation view of the connector in position in a track of the perimeter trim strip.

FIG. 16 is a sectional view taken on the line 16-16 of FIG. 15.

DETAILED DESCRIPTION OF THE INVENTION

Figure 1:
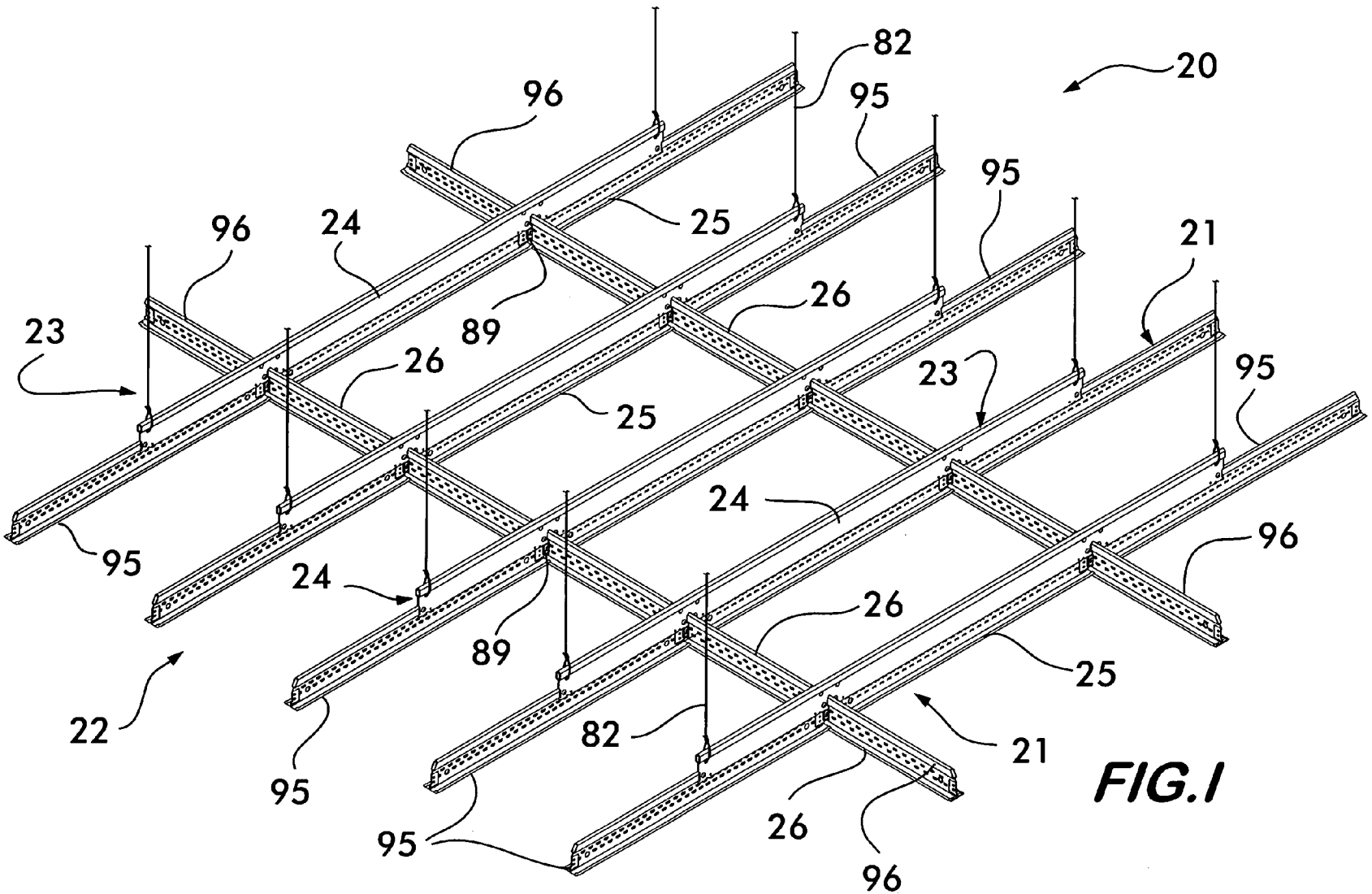
FIG. 1 is a perspective view, taken from above, showing the suspended ceiling segment of the invention, without the perimeter trim strip, and without ceiling panels.

The ceiling segment 20 of the invention is intended to be suspended from a structural ceiling, either directly below the structural ceiling, or indirectly, below a wall-to-wall suspended ceiling. Grid 21 extends horizontally in a lower tier 22 beneath a structural ceiling. The lower tier 22 is formed by the grid 21 of interconnected cross beams 25 and main beams 26. The tier 22 formed by grid 21 is supported by an upper tier 23, of support hangers 24.

Figure 2:
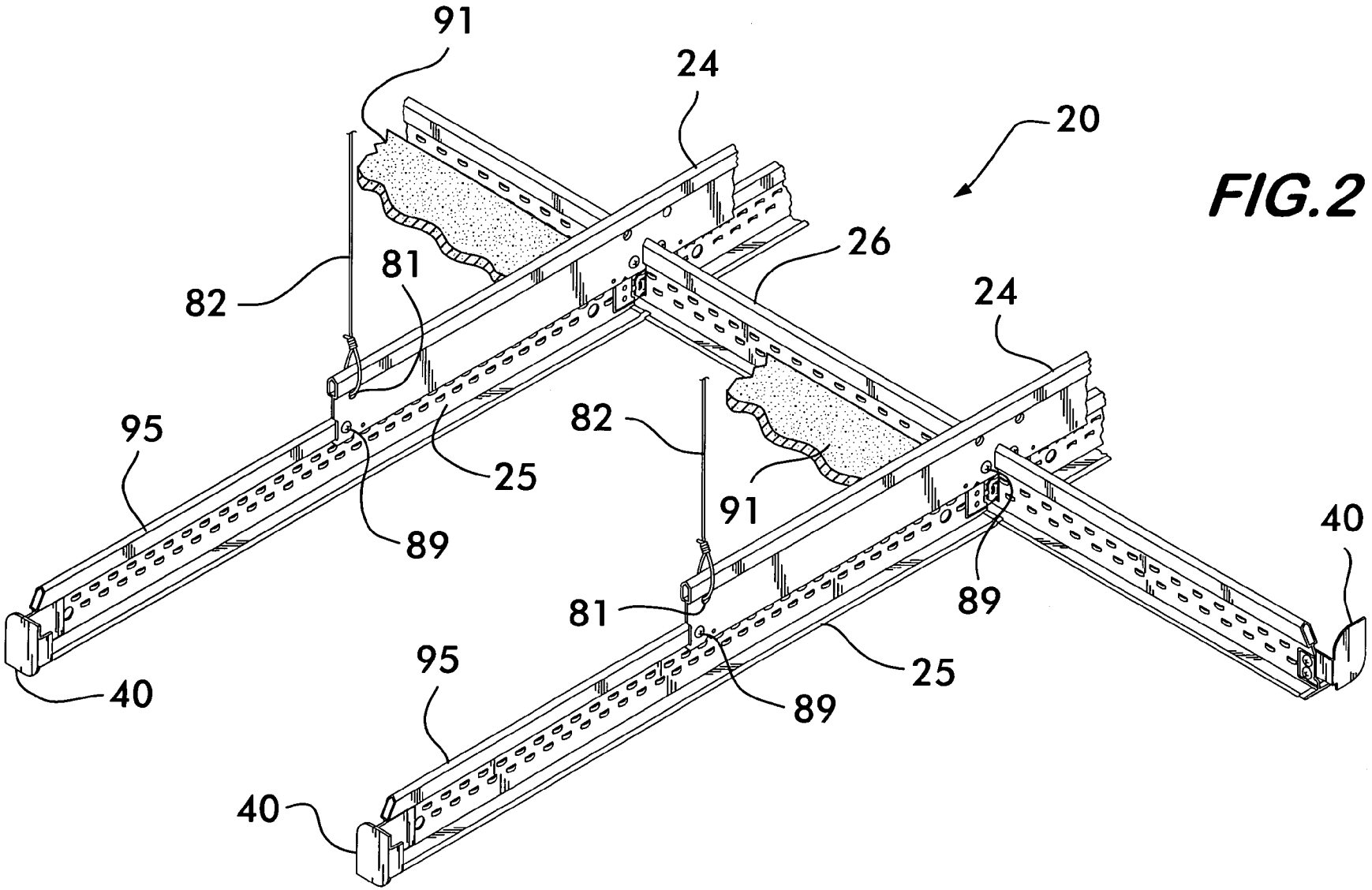
FIG. 2 is a partial enlarged perspective view of the suspended ceiling segment shown in FIG. 1.

Support hangers 24 extend separately parallel to each other, each along a line of cross beams 25, and crossing perpendicularly over the main beams 26, as shown particularly in FIGS. 1 and 2.

A grid 21 of cross beams 25 interconnected with main beams 26 is shown, for instance, in U.S. Pat. Nos. 4,912,894, 5,839,246, and 6,178,712, incorporated herein by reference. Cross beams 25 interconnect through slots in main beams 26. Main beams 26 extend the length of ceiling segment 20, either in one length, or connected together end to end where the length of the ceiling segment 20 extends beyond the usual 12 ft. standard length of a main beam. Cross beams 25 and main beams 26 are formed, as well known, from a strip of flat metal that is bent, as by roll forming, into a beam having, in cross section, a bulb 30 at the top, a vertical, downward extending web 31, and horizontally extending flanges 32, at the bottom of the web 31, as seen for instance, in FIG. 10.

The web 31 can optimally have stitching 33 that secures two layers of the web 31 together, as shown for instance in U.S. Pat. No. 5,979,055, incorporated herein by reference.

Cross beams 25 and main beams 26 have at their ends connectors 40, as shown particularly in FIGS. 12 through 14. Connector 40 has a face 41 extending at a right angle to arm 42. Arm 42 of a connector 40 is secured at the end of outermost beams 25 and 26 in the grid 21.

Face 41 is generally rectangular in cross section with curved corners 43 and 44 positioned diagonally from one another. A connector 40 is engaged into a track 62 of a perimeter trim strip 60, as seen in FIG. 14.

Support hangers 24 are desirably formed of a heavier gauge metal than that of the beams 25 and 26. The support hangers 24 are, for instance, 2 inches in height and have a bulb 70 formed, as by roll forming, above a single layer web 71. The bulb 70 at the top of the support hanger 24, as seen for instance in FIG. 10, curves from the web 71 into a cross section having vertically spaced sides and a peaked top.

Support hangers 24 have perforated openings, as seen particularly in FIG. 9. A support hanger cut-out 72 conforming to the cross section of bulb 30 of cross beam 25 is formed in the web 71 and has extending vertically below the support hanger cut-out 72 a slot 73 which conforms to the thickness of web 31 in beams 25 and 26.

There extends on each side of support hanger cut-out 72 holes 75 and 76, and at the bottom edge of web 71, inverted V-shaped cut-outs 77 and 78. Upper holes 80 and 81 extend through web 71 below bulb 70 of hanger 24, which receive hanger wires 82 that are suitably anchored in a structural ceiling, either directly, or indirectly through a wall-to-wall suspended ceiling.

The cut-outs and holes set forth above extend periodically at, for instance, 24 inch intervals along the hangers 24, so that in a ceiling segment 20, a support hanger cut-out 72 lines up with a bulb 30 of a main beam 26.

Perimeter trim strip 60, suitably in one piece of extruded metal, has an outside plain or decorative surface 61 that is visible to a viewer from below. Such perimeter trim strip 60 extends around the periphery of the suspended ceiling segment 20.

The perimeter trim strip 60 has one or more inner tracks 62, as shown for instance in the above cited '792 and '844 patents.

The perimeter trim strip 60 has optionally upper and lower inward extending lips 63 and 64 that provide a further cover for the ends of beams 25 and 26.

The lower lip 64 can also serve as a ledge to which the flanges 32 of beams 25 and 26 can connect.

The above described ceiling elements are assembled into the ceiling segment 20 of the invention that is shown in the drawings.

Figure 3:
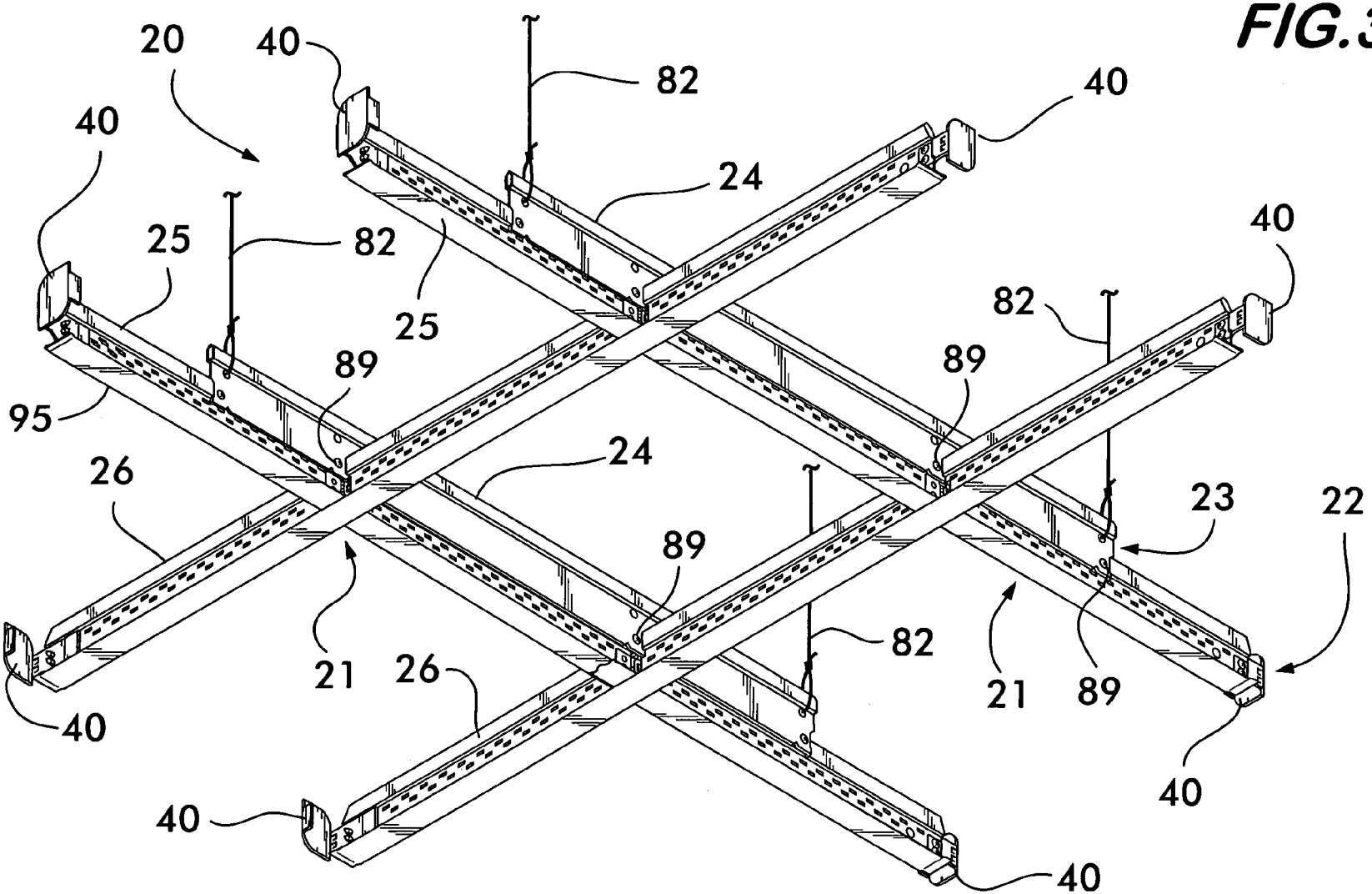
FIG. 3 is a perspective view, taken from below, of a suspended ceiling segment of the invention, smaller in horizontal spread than that shown in FIG. 1, with the connections for the perimeter trim strip attached.

Ceiling grid 21 is assembled in the well known prior art manner, wherein cross beams 25 are inserted through spaced slots in the main beams 26 to form the grid 21 as seen for instance in FIGS. 1 and 3. Main beams 26 are spaced parallel to one another, and cross beams 25 connect to the main beams 26 perpendicularly.

The ceiling segment 20 has main beams 26 that are used singularly, or joined end-to-end, to form the required length of the ceiling segment 20. If the length is other than a multiple of 12 ft., the main beam or beams 26 can be cut to achieve the desired length.

The main beam 26 is, or the joined main beams 26 are, placed parallel to one another 4 ft. apart, which is the standard length of a cross beam 25. Cross beams 25 are connected to the main beams 26 through slots, as well known. The grid 21 is thus formed to the desired horizontal spread in the direction of the main beams 26, and in the direction of the cross beams 25.

The support hangers 24 of the invention are then attached to the grid to form the ceiling segments shown particularly in FIGS. 1 through 3.

Figure 7:
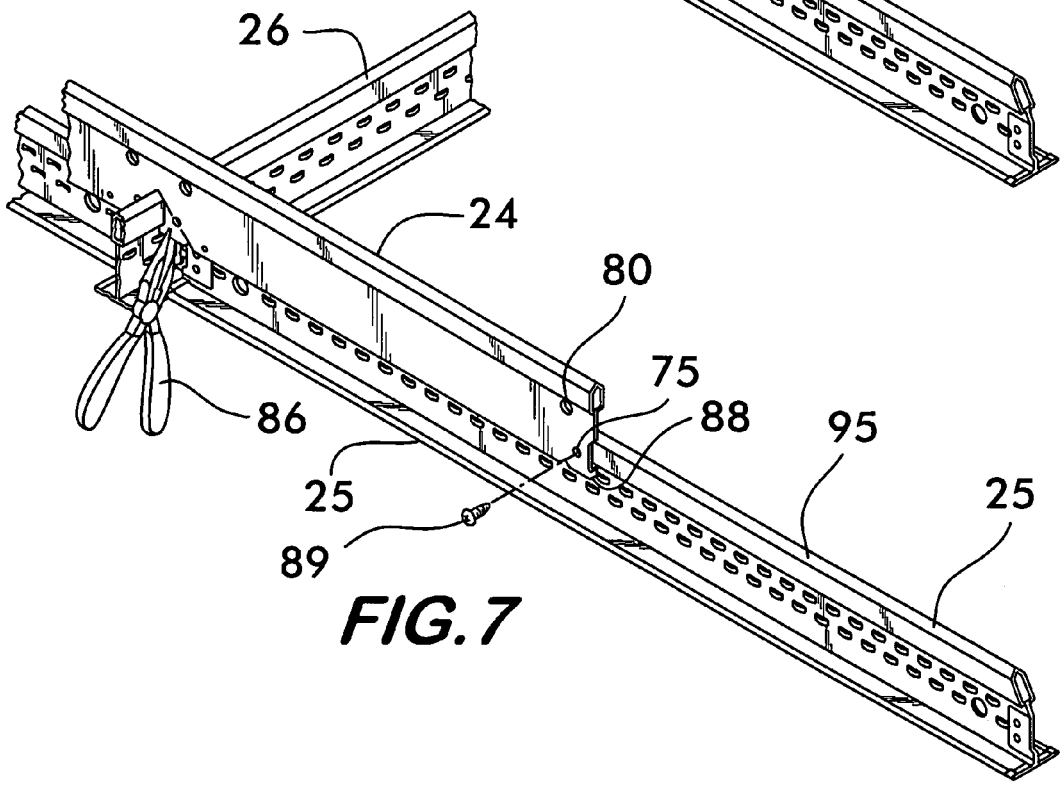
FIG. 7 is a perspective view, similar to FIG. 6, showing further steps in affixing the support hanger of the invention to a main beam, and to a cross beam.

The support hangers 24 of the invention are attached individually over, and to, the grid 21, along each row of cross beams 25. As seen particularly in FIGS. 5 through 8, a triangular portion 85 along one side of support hanger cut-out 72 is manually bent upward with pliers 86, and then placed over bulb 30 of main beam 26, along the line of a row of cross beams 25. The triangular bent portion 85 is then bent downward, as seen in FIG. 7, so that the support hanger cut-out 72 surrounds bulb 30 of main beam 26. Hole 76, and V cut-out 78 provide a fold line, as shown along dotted line 79, as shown in FIG. 8.

Bends of the triangular portion 85 from the support hanger cut-outs 72 as described above are first made along the entire support hanger 24, so that a support hanger 24 can be put in position in the suspended ceiling segment 20, and then the bent triangular portions 85 can be returned to their original positions, so that the support hanger 24 is locked to the grid 21. The support hangers 24 are further secured to the cross beams 25 with self-tapping screws 89 that pass through holes 81 and 82 into the bulbs of cross beams 25 to hold web 71 of support hanger 24 against the cross beam, as seen particularly in FIG. 10.

The length of a support hanger 24 is critical to the invention. The length of support hanger 24 is such that it extends along a row of cross beams 25 and terminates at each end along the outermost cross beam 25 at opposing sides of the suspended ceiling segment 20. The support hanger 24 is then attached to the outermost cross beam 25 to cantilever such cross beam, as seen in the drawings, and as described below.

Figure 9B:
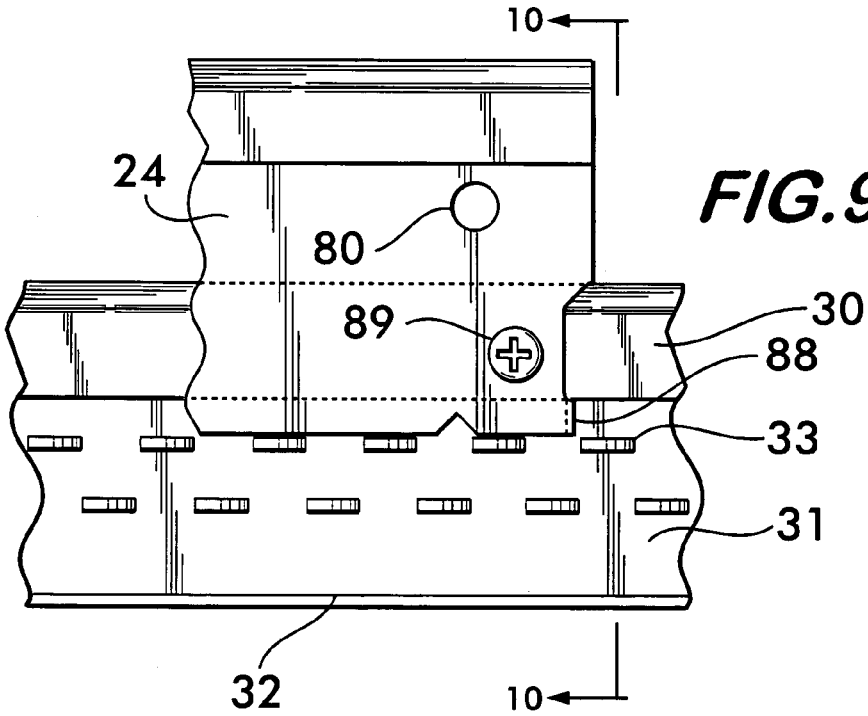
FIG. 9*b* shows the support hanger of 9*a* attached to a cross beam in a way that cantilevers the cross beam.
Figure 10:
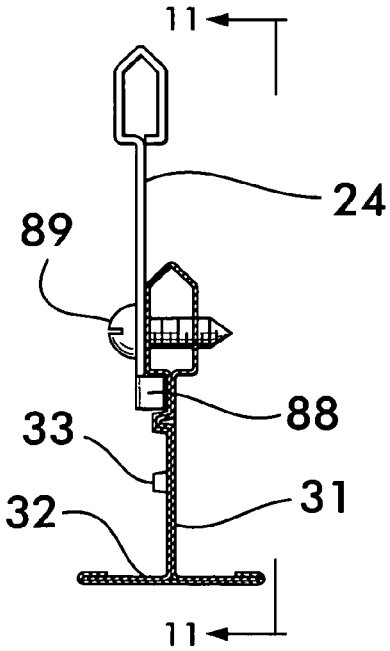
FIG. 10 is a sectional view taken on line 10-10 of FIG. 9*b*.

To so attach the support hanger 24 to an outermost cross beam 25, the hanger 24 is cut vertically along a line 90 that bisects a support hanger cut-out 72 as seen in FIGS. 9 and 10. Such support hanger cut-outs 72 are preformed in the support hangers 24 at repetitive intervals of, for instance 24 inches, so that the support hanger 24 is secured to the outermost cross beam 25 half way along its length, resulting in a 24 inch cantilevered segment 95.

As seen in FIG. 9, the cut is made vertically from the center of support hanger cut-out 72 of the support hanger 24 along dotted line 90, as illustrated in FIG. 9. A cut support hanger 24, as shown in FIG. 9*a*, has a bottom tab 88 that remains after the cut.

Figure 11:
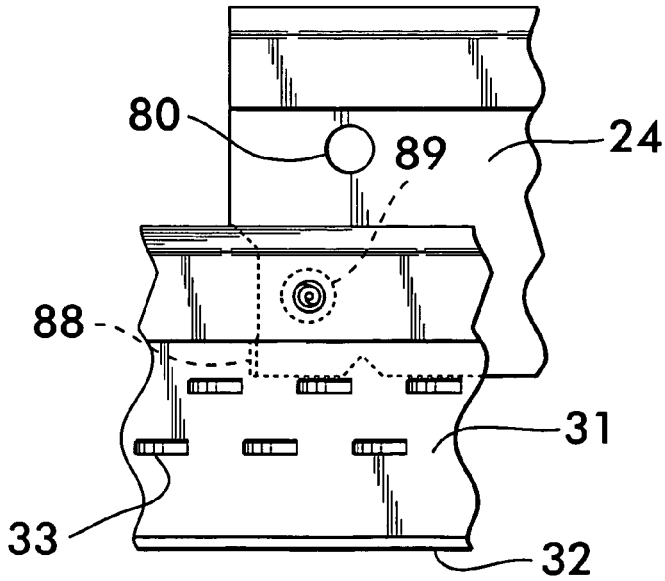
FIG. 11 is similar to FIG. 9*b*, viewed from the opposite side.

As seen in particularly FIGS. 9*b*, 10, and 11, tab 88 is bent inward to a right angle, so that it fits under bulb 30, of cross beam 25.

A self-tapping screw 89 is passed through hole 75 in the support hanger 24 and is fastened to bulb 30 of cross beam 25.

The above process is repeated throughout the suspended ceiling segment 20 until the completed ceiling segment 20, as shown for instance in FIGS. 1 to 4, is constructed.

In such suspended ceiling segment 20, ends of main beams 26 extend beyond the support hangers 24, in a direction perpendicular to the rows of support hangers 24 and the rows of cross beams 25. Since, in the grid 21, the cross beams 25 are connected to the main beams at 24 inch spacings, the main beams 26 will extend 24 inches beyond the outermost row of the support hangers 24, so that the cantilevered portion 96 of the main beams 26 at the ends of the main beams 26 will also be of a 24 inch length, as is the cantilevered portion 95 of the cross beams 25.

Figure 4:
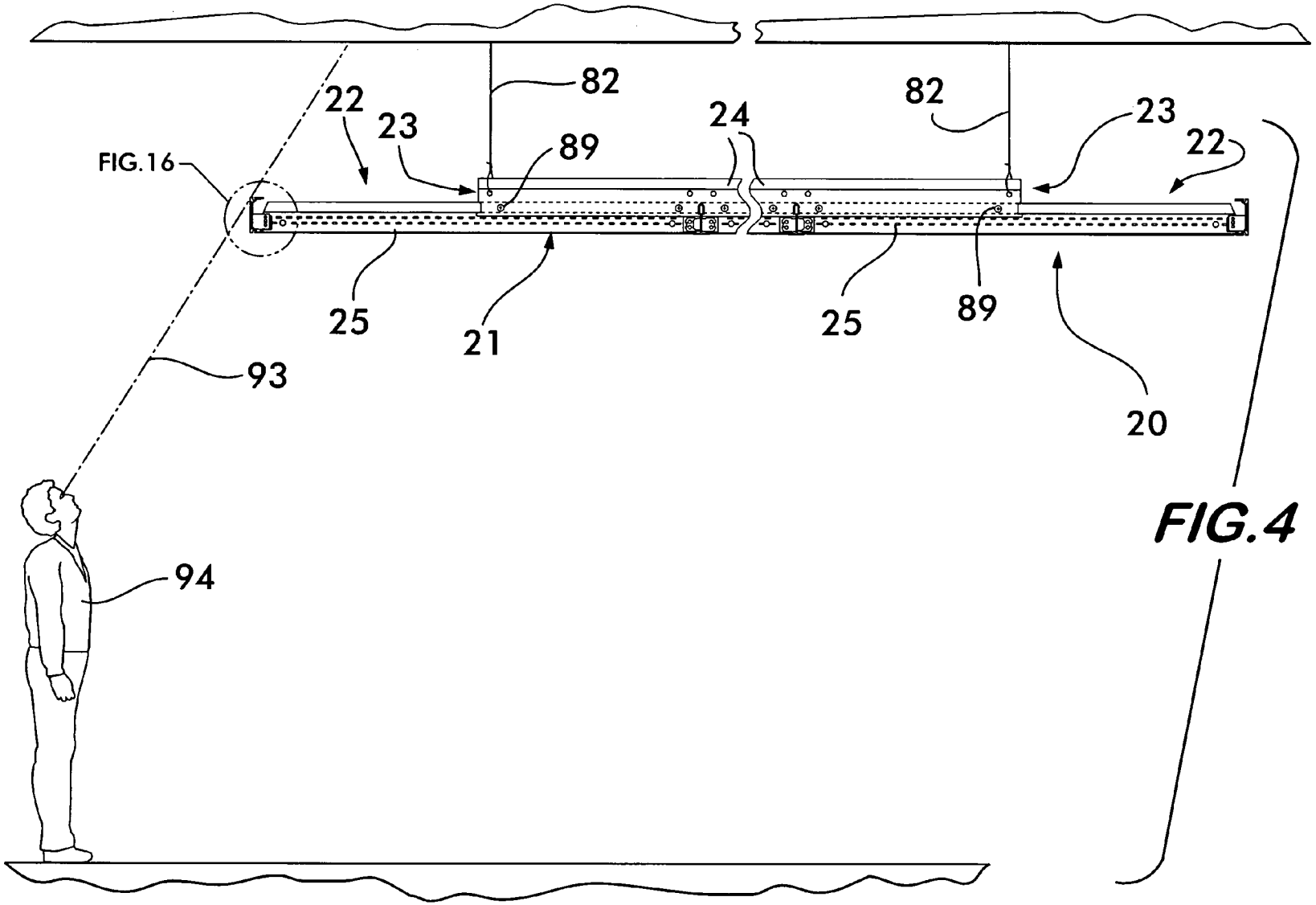
FIG. 4 is a schematic side view of the suspended ceiling segment of the invention showing the line of sight of a viewer positioned below the suspended ceiling segment.
Figure 5:
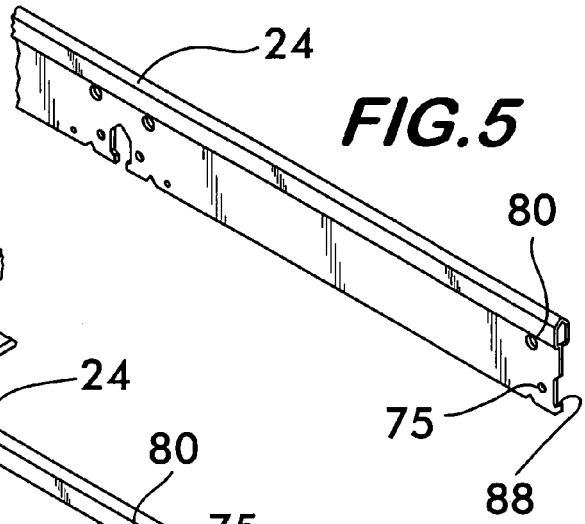
FIG. 5 is a perspective view of a portion of a support hanger of the invention.
Figure 6:
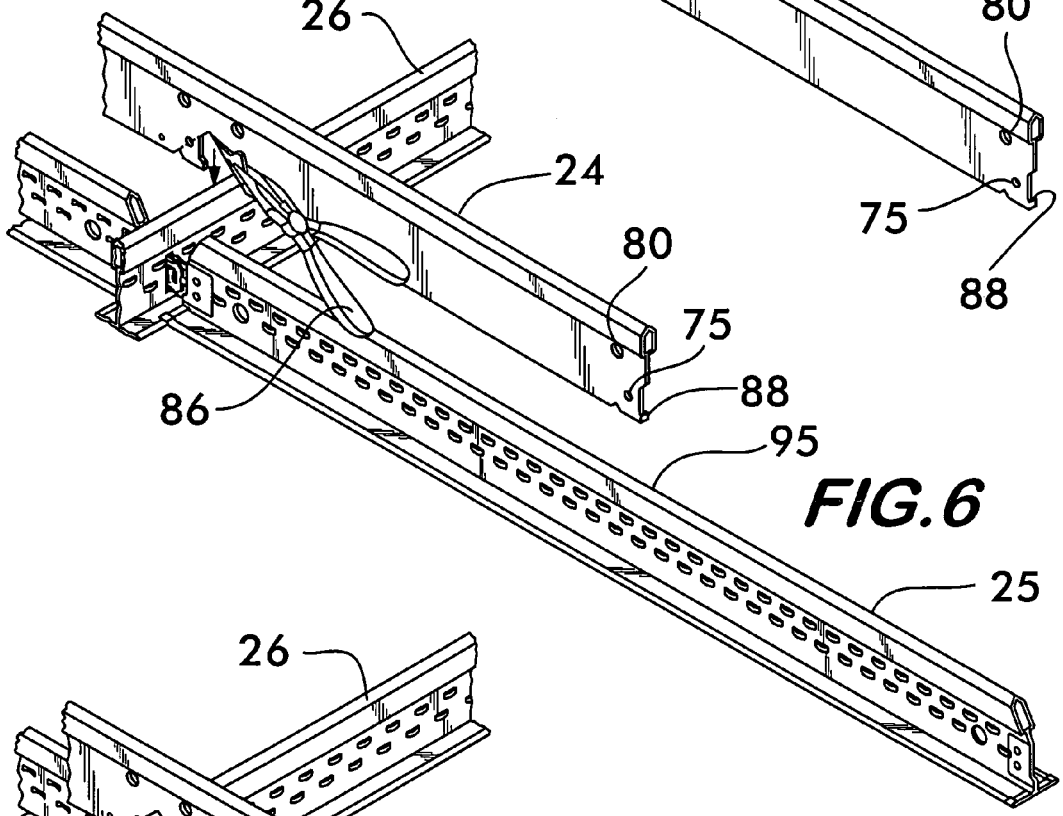
FIG. 6 is a perspective view of the first step in the way a support hanger is affixed to a main beam.

In the above described suspended ceiling segment 20, the ends of both the cross beams 25 and main beams 26 are cantilevered beyond the support hangers 24 to an extent that, when the perimeter trim strip 60 is attached to the suspended ceiling segment 20, and the suspended ceiling segment 20 is suspended from the structural ceiling, and the ceiling panels 91 are in position, as shown in the Figures, the hang wires 82, support hangers 24, and grid 21 other than the lower faces of flanges 32, will be hidden from the line of sight 93, of a viewer 94 positioned below the suspended ceiling segment 20, as seen in FIG. 4.

The cantilevered beam ends 96 on main beams 26 and the cantilevered beam ends 95 on cross beams 25 are twisted to position connector 40 on the inner track 62 of perimeter trim strip 60, as shown in FIGS. 13 and 14. Screws 46 pass through holes 47 into the web 31 on the ends of the beams 25 and 26 to secure the connector 40 to the beams.

In inserting the connector 40 into the track 62 of perimeter trim strip 60, the cantilevered beam end 95 or 96 is twisted until opposing curved corners 43 and 44 of face 41 of connector 40 are vertically aligned. This permits the connector 40 to be inserted into track 62. When the twisted beam end 95 or 96 is returned to its untwisted condition, the connector 40 rotates into a vertical position in which the top and bottom of face 41 engages the ridges 63 in track 62, to engage the connector 40 in the track 62 of the perimeter trim strip 60.

Lanced projections 48 at the top and bottom of face 41 engage the track 62 to further secure the connector 40 in the track 62 of perimeter trim strip 60. Optionally, abutments 49 can be lanced in arm 42 to provide stops for the end of a beam 25 or 26, to position the connector 40 prior to securing the connector 40 to the beam with screws, when desired.

The entire suspended ceiling segment 20 hangs from an upper structure, to provide a floating effect, as seen in FIG. 4.

Ceiling panels 91, as well known, are placed in the grid 21 openings to complete the suspended ceiling segment 20.

The structure of the invention, by virtue of the tier arrangement of support hangers 24 and grid 21, permits the load of the ceiling segment 20 to be concentrated in the horizontal interior of the suspended ceiling segment 20. Such a load can be suspended from an upper structure with hanger wires that are behind the line of sight of a viewer positioned below.

By cantilevering the ends 95 and 96 of the beams 25 and 26 in the grid 21 that forms the lower tier 22 of the ceiling segment 20 from an upper tier of support hangers 24, the cantilevered ends 95 and 96 of beams 25 and 26 can be twisted to permit connectors 40 on the ends of the beams to readily engage the perimeter trim strip 60.

What is claimed is:

1. In a suspended ceiling segment with a horizontal grid of intersecting main and cross beams, with openings in the grid that support ceiling panels, and a perimeter trim strip that extends around the ends of the beams in the grid, and wherein the grid is supported from above by hanger wires, the improvement comprising a support hanger having a first end, a second end, and an extended body wherein said first end of said support hanger is provided for attachment to a first cross beam and terminates short of the length of said first cross beam;

said second end of said support hanger is provided for attachment to a second cross beam and terminates short of the length of said second cross beam;

said extended body of said support hanger is provided for attachment to a third cross beam; and, said support hanger extends through a first intersection of a first main beam and said first and third cross beams and a second intersection of a second main beam and said second and third cross beams;

so that each of said first and said second cross beams have a cantilevered section extending outwardly from said first and said second ends respectively of said support hanger.

2. The suspended ceiling segment of claim 1, wherein the cantilevered sections of the beams can be twisted to permit connectors on the end of the cantilevered sections to engage a track on the perimeter trim strip.

3. The suspended ceiling segment of claim 1, wherein the support hangers and hanger wires are hidden from the line of sight of a viewer positioned below the suspended ceiling segment.

4. The suspended ceiling segment of claim 2, wherein the connectors have opposing curved corners that permit the connector to be positioned within a track on the perimeter trim strip when the beam end is twisted, and then engage the track when the beam returns to an untwisted position.

5. The suspended ceiling segment of claim 4 wherein the connector engaged in a track on the perimeter trim strip can be locked in the track with lanced projections lanced from the connector.

6. The suspended ceiling segment of claim 1, wherein said support hanger is joined to a main beam of the grid by a hanger cut-out that is bent open to seat the hanger on the main beam, and is bent closed to lock the hanger to the main beam.

7. The suspended ceiling segment of claim 6, wherein a tab at the bottom of the support hanger cut-out is bent inward at a right angle to fit under the bulb of a cantilevered section of a cross beam.

8. The suspended ceiling segment of claim 7, wherein the support hanger is held against the cross beam by screws.

* * * * *